US006068203A

United States Patent [19]

DeYoung et al.

[11] Patent Number: 6,068,203

[45] Date of Patent: May 30, 2000

[54] SELECTIVE VENTING SPRAYER

[75] Inventors: Roger L. DeYoung, Nolensville; Stanley D. Neal, Mt. Juliet, both of Tenn.; Gary E. Biddle, Carlisle, Pa.

[73] Assignee: Campbell Hausfeld/Scott Fetzer Company, Harrison, Ohio

[21] Appl. No.: 09/244,944

[22] Filed: Feb. 4, 1999

[51] Int. Cl.[7] ..... B05B 1/30

[52] U.S. Cl. ..... 239/297; 239/301

[58] Field of Search ..... 239/297, 301

[56] References Cited

U.S. PATENT DOCUMENTS

| | | | |
|---|---|---|---|
| 1,752,922 | 4/1930 | Mueller | 239/297 |
| 1,919,153 | 7/1933 | Andrews . | |
| 2,740,670 | 4/1956 | Harder | 239/297 |
| 4,531,675 | 7/1985 | Muck | 239/301 |
| 5,135,172 | 8/1992 | Toth | 239/297 |
| 5,217,168 | 6/1993 | Svendsen | 239/297 |
| 5,279,461 | 1/1994 | Darroch | 239/297 |
| 5,529,460 | 6/1996 | Eihusen et al. | 239/124 |
| 5,645,220 | 7/1997 | Hohndorf | 239/301 |

*Primary Examiner*—Lesley D. Morris
*Attorney, Agent, or Firm*—Jones, Day, Reavis & Pogue

[57] ABSTRACT

A selective venting spray assembly is disclosed which includes a sprayer for dispersing a spray of liquid and a spray shaping air flow. An aircap is attached to the sprayer for atomizing and directing the spray. The aircap includes one or more spray shaping passages for receiving the airflow and directing it against the spray to alter the shape of the spray. A flow channel assembly is provided to fluidly connect the aircap to the sprayer. The flow channel assembly includes a flow passage selectively switchable between a first position where airflow is admitted from the sprayer to the spray shaping passage, and a second position where the airflow is diverted to a vent, to produce a non-shaped spray without creating damaging back pressure within the sprayer.

10 Claims, 4 Drawing Sheets

SELECTIVE VENTING SPRAYER

BACKGROUND OF THE INVENTION

The present invention is directed to the field of sprayer systems, particularly those of the type used to produce more than one spray pattern, e.g. high volume, low pressure (HVLP) paint sprayers that use air jets to deform a circular spray pattern into a flat "fan" spray pattern.

A typical paint sprayer includes a sprayer nozzle that disperses a diverging conical spray envelope of paint for producing a circular pattern. Typical sprayers also include an aircap for alternately admitting the conical spray or deforming it into a fan pattern. The aircap includes spray shaping passages formed in wings of the aircap, on either side of the conical spray. These passages direct pressurized air from within the sprayer toward the conical spray, altering the shape of the conical spray to flatten it into a fan pattern.

The round pattern is selectively restored by shutting off the spray shaping passages. This is commonly accomplished by providing a rotatable aircap which is movable between two positions. In the first position, the spray shaping passages are in registration with corresponding openings in the sprayer, to admit pressurized air to the aircap shaping passages. The aircap can then be rotated to a second position where the spray shaping passages are blocked, thereby discontinuing airflow. However, this shut-off condition restricts the flow of air through the sprayer system, thus creating an increase in back pressure and motor speed (i.e. RPMs). This increases heat in the motor, resulting in additional wear and tear and thereby reducing the expected service life of the motor, and increases heat in the air hose, thus reducing its structural integrity.

SUMMARY OF THE INVENTION

In view of the difficulties and drawbacks encountered with previous systems, there is therefore a need for a selective sprayer system in which the air motor observes equalized flow and pressure in both fan and circular positions.

There is also a need for a selective sprayer having an air motor with reduced operational wear and increased motor life and hose life.

These needs and others are satisfied by the present selective venting spray assembly which includes a sprayer for dispersing a spray of liquid and a spray shaping air flow. An aircap is attached to the sprayer for atomizing the fluid and directing the spray. The aircap includes one or more spray shaping passages for receiving the air flow and directing it against the spray to alter the shape of the spray. A flow channel assembly is provided to fluidly connect the aircap to the sprayer. The flow channel assembly includes a variable flow passage selectively switchable between a first position that admits air flow from the sprayer to the spray shaping passage, and a second position that diverts the air flow to a vent, to produce a non-shaped spray without creating back pressure within the sprayer.

As will be appreciated, the invention is capable of other and different embodiments, and its several details are capable of modifications in various respects, all without departing from the invention. Accordingly, the drawings and description are to be regarded as illustrative in nature and not restrictive.

DETAILED DESCRIPTION OF THE INVENTION

Figure 1:
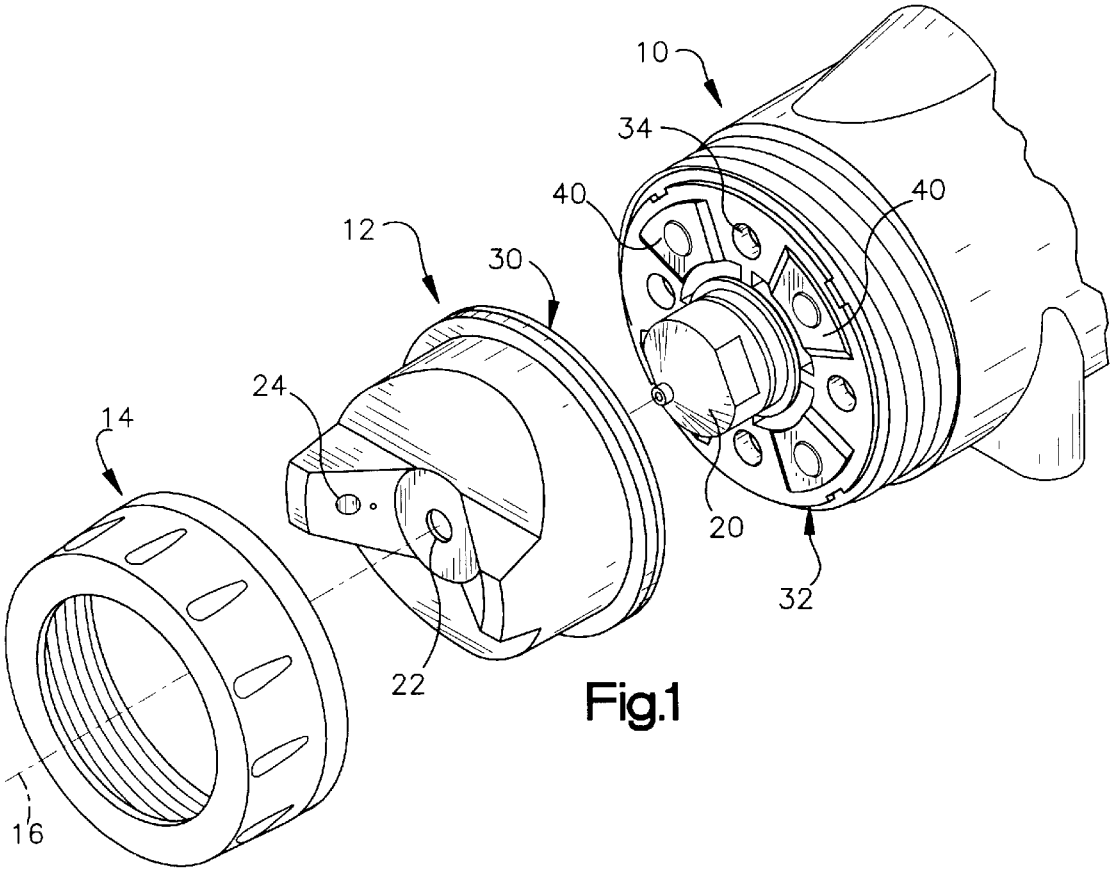
FIG. 1 is an exploded view illustrating the general aircap assembly as according to the present invention.

The figures will now be discussed where it is understood that like reference numerals correspond to like elements, wherein a selective venting sprayer system is shown that operates with continuous air flow and pressure while functioning, in circular pattern and fan pattern modes. FIG. 1 shows a sprayer 10 which cooperates with an aircap 12 and is attached with a retaining ring 14, all of which are assembled along a central axis 16. The retaining ring 14 can be a typical threaded ring as shown, received by mating threads on the sprayer 10. The retaining ring 14 can optionally employ a biasing spring to apply a biasing force during rotational indexing. Alternatively, the retaining ring can include an integral spring such as shown in U.S. application Ser. No. 09/240,808, filed Feb. 1, 1999, and entitled "INDEXING AIRCAP RETAINING RING", also to the present inventor, the disclosure of which is hereby incorporated by reference.

An HVLP spray gun atomizes fluids with low pressure air (10 psi or less). Fluid is discharged from the fluid nozzle 20 and atomization takes place at the aircap 12 in an area directly in front of the nozzle 20. Air from the sprayer 20 passes over the nozzle 20 and through a central hole 22 in the aircap 12, producing a diverging conical spray of atomized fluid, e.g. paint. This conical spray can selectively be reshaped into a flat fan spray pattern using spray shaping passages 24, formed with wings of the aircap 12, and displaced from the central axis 16. These passages 24 receive air from the sprayer 10, which can be selectively directed to the conical spray. The spray shaping passages 24 are inclined at an angle toward the central axis 16, preferably about 45 degrees, to produce the desired shaping.

The aircap 12 is selectively indexed between a circular pattern position and a fan pattern position by rotating the aircap 12 about the axis 16, in order to respectively block and unblock the spray shaping passages 24. In order to prevent creating damaging back pressure within the sprayer 10, the present invention includes a flow channel assembly, external to the aircap 12, for fluidly connecting the aircap 12 to the sprayer 10. This flow channel assembly defines a flow passage, switchable with the selective indexing of the aircap 12 between a first position that admits air flow from the sprayer to the spray shaping passages 24 and a second position that diverts the air flow to a vent when the spray shaping passages 24 are blocked.

In the preferred embodiment, as illustrated, the flow channel assembly is defined by first and second blocking members, in the form of an aircap plate 30, affixed to the aircap 12, and a sprayer plate 32, affixed to the sprayer 10. The aircap and sprayer plates 30, 32 are substantially abutting when assembled, but are rotationally movable with respect to each other, following the rotation of the aircap 12. The aircap plate 30 includes two apertures, opened to the spray shaping passages 24. The sprayer plate 32 as shown includes four apertures 36, equally spaced and centered about the axis 16. However, the sprayer plate 32 can include two apertures, or any other respective numbers of corresponding apertures without departing from the invention. The sprayer plate apertures 36 are open to an air flow passage within the sprayer 10. Flow passages to the spray shaping passages 24 are established when the spray plate apertures 34 are in registration with a respective pair of sprayer plate apertures 36. In the illustrated embodiment, the apertures 34 are in registration with apertures 36, when the aircap 12 is in either a horizontal or vertical orientation.

Figure 2:
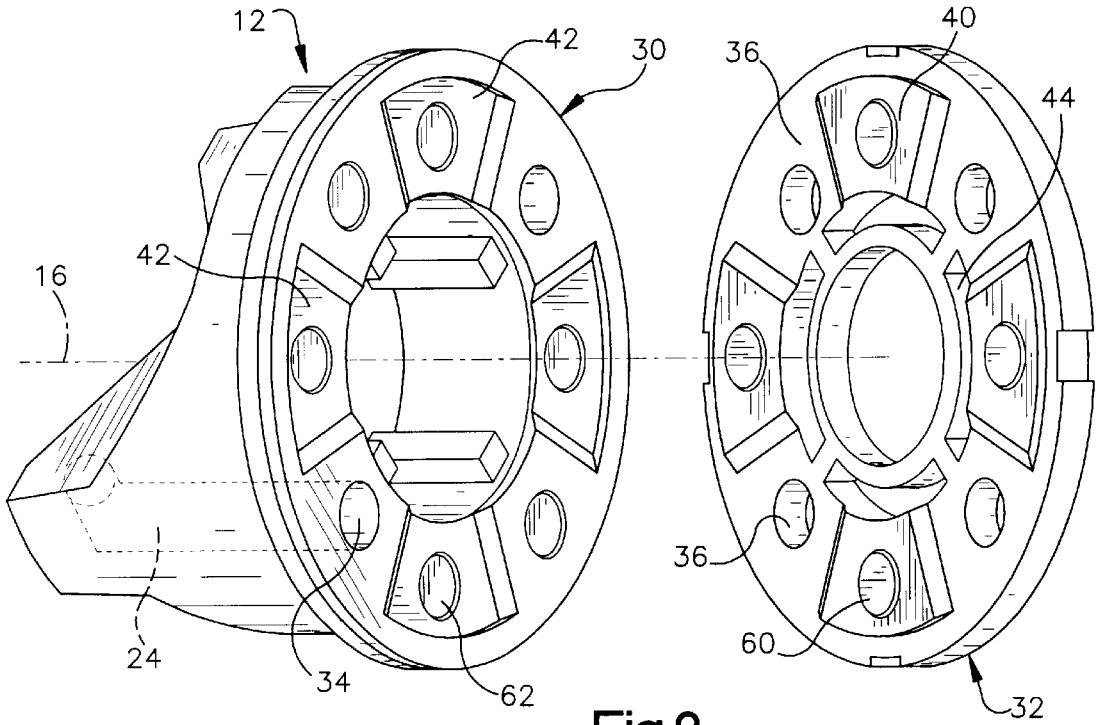
FIG. 2 is an exploded view detailing the aircap plate and sprayer plate of the present invention.

As shown in FIG. 2, the aircap plate 30 and the sprayer plate 32 each include a substantially flat surface plane. The sprayer plate 32 preferably includes a plurality of restriction wings 40 in the form of arcuate relieved portions extending outwardly from the plane of the sprayer plate 32, and spaced in between the sprayer plate apertures 36. The restriction wings 40 are dimensioned in order to be received within corresponding arcuate recessed portions 42, formed inwardly from the plane of the aircap plate 30. The wings 40 and recessed portions 42 are formed to be mating surfaces, and cooperate with the respective surface planes to form a transverse flow passage, as will be shown below. It should be understood that the wings 40 and recessed portions 42 could be formed on the respective other plates 30, 32, or both, all without departing from the invention. The aircap plate 30 and the sprayer plate 32 are each generally annular, and include respective central passages. The recessed portions 42 meet the edge of the aircap plate annular passage to permit fluid communication there between. The central passage of the sprayer plate 32 is smaller, sized to be secured behind the nozzle 20. A number of arcuate apertures 44 are formed radially outward from the sprayer plate central passage, adjoining the restriction wings 40, for admitting atomizing air into the central hole of the aircap 12.

Figure 3A:
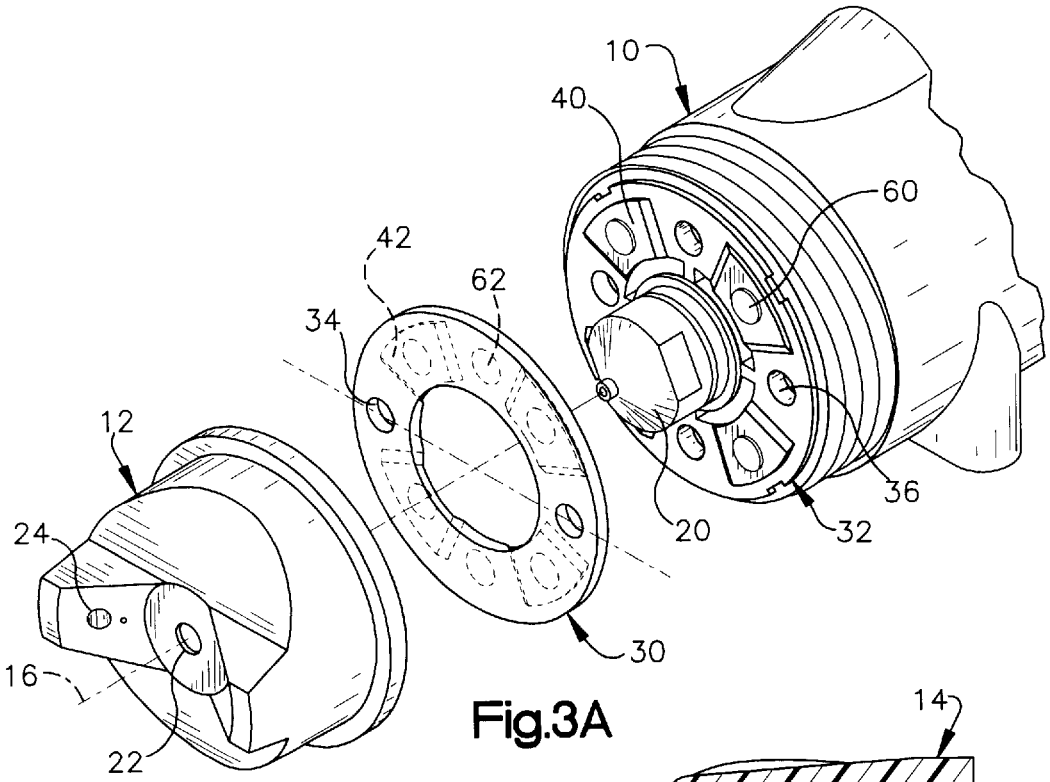
FIGS. 3A, B and C are respective exploded, side sectional, and oblique sectional views depicting the assembly and operation of the present sprayer in a first operative position.
Figure 3B:
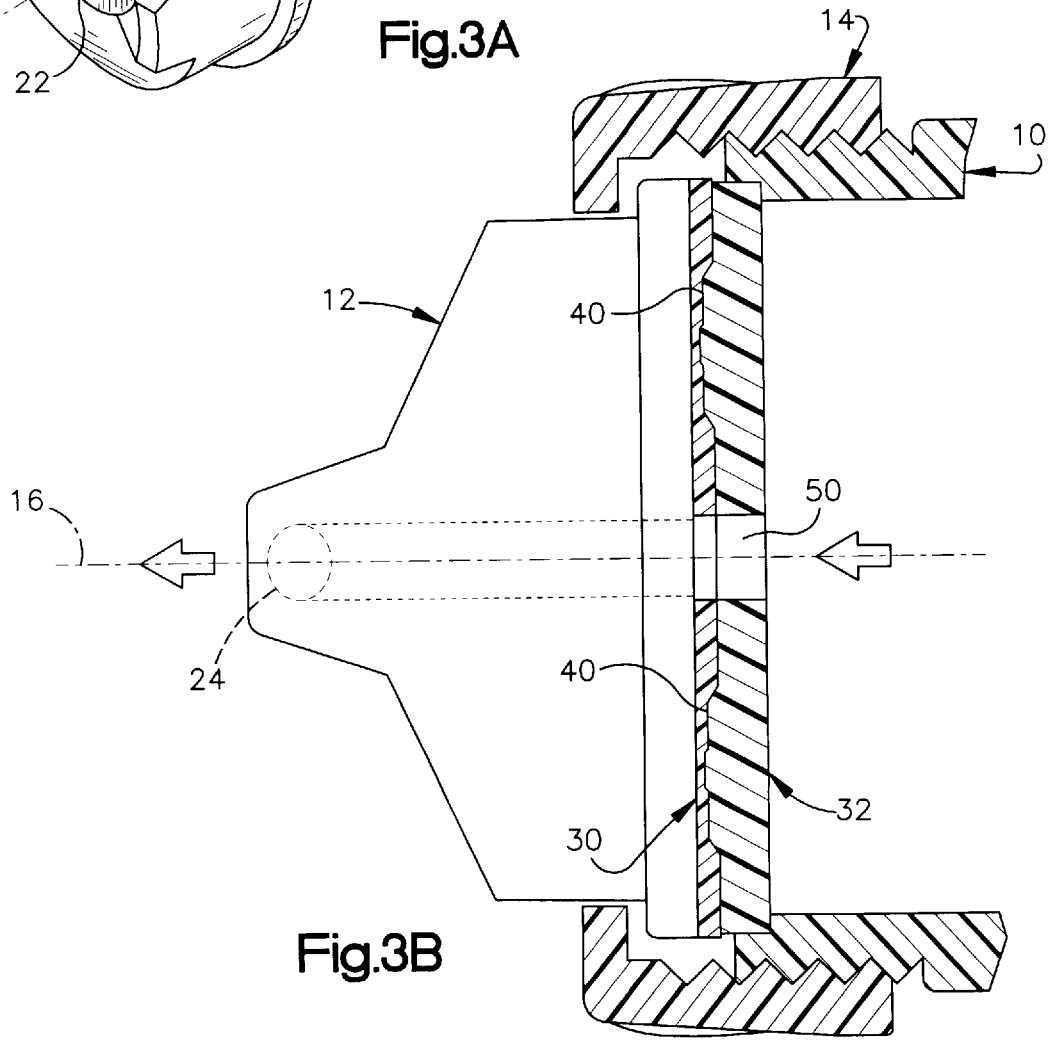
Figure 3C:
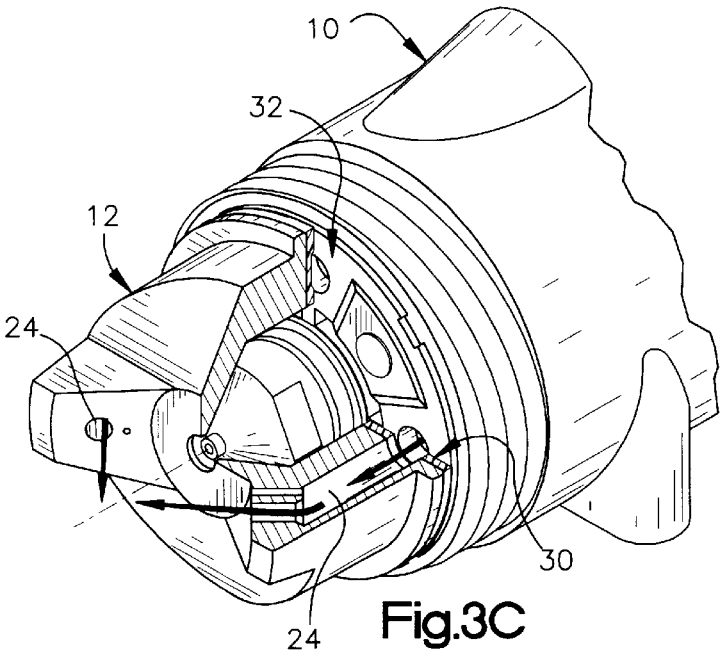

FIGS. 3A, 3B and 3C show the present sprayer in the first position. The apertures 34, 36 are in registration, and the flow passage 50 fluidly connects the spray shaping passage 24 to the air supply. The restriction wings 40 are received within the respective recessed portions 42, so that the respective surface planes substantially abut, thereby sealing the transverse passage between the plates 30, 32 against airflow.

Figure 4A:
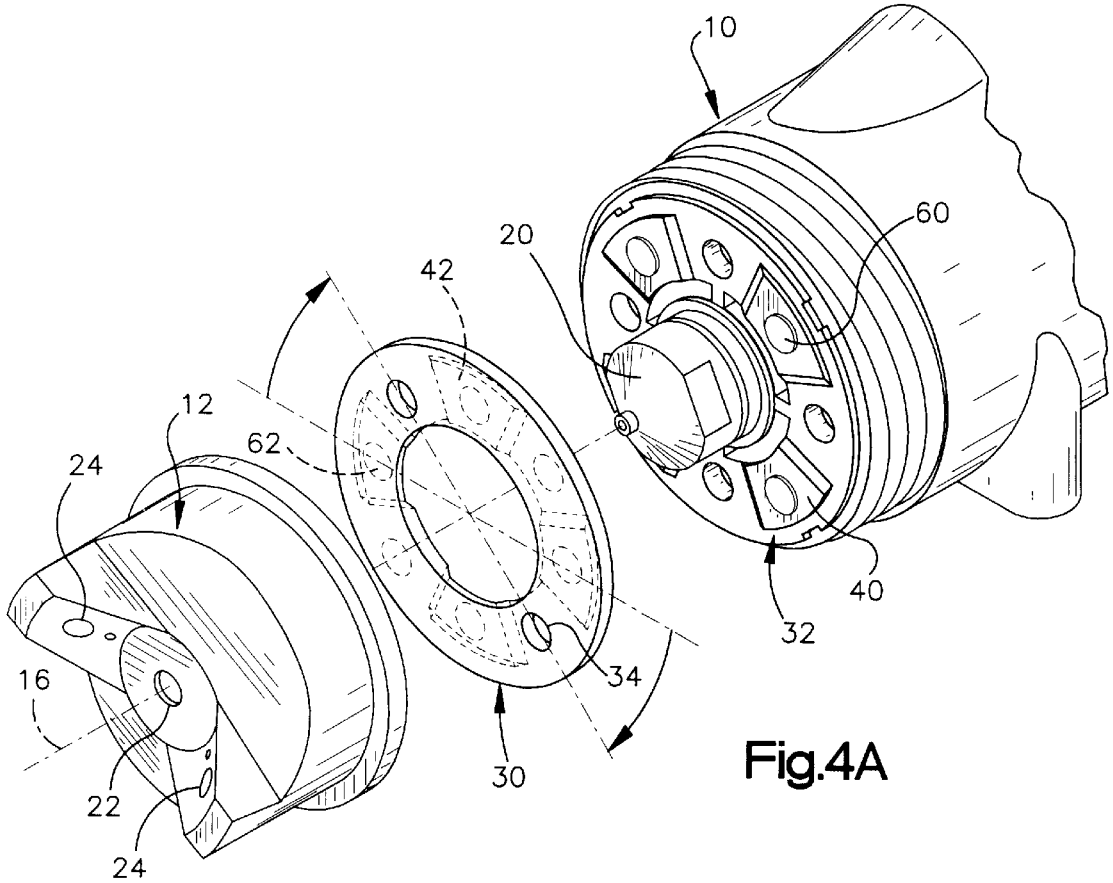
FIGS. 4A, B and C are respective exploded, side sectional, and oblique sectional views depicting the assembly and operation of the present sprayer in a second operative position.
Figure 4B:
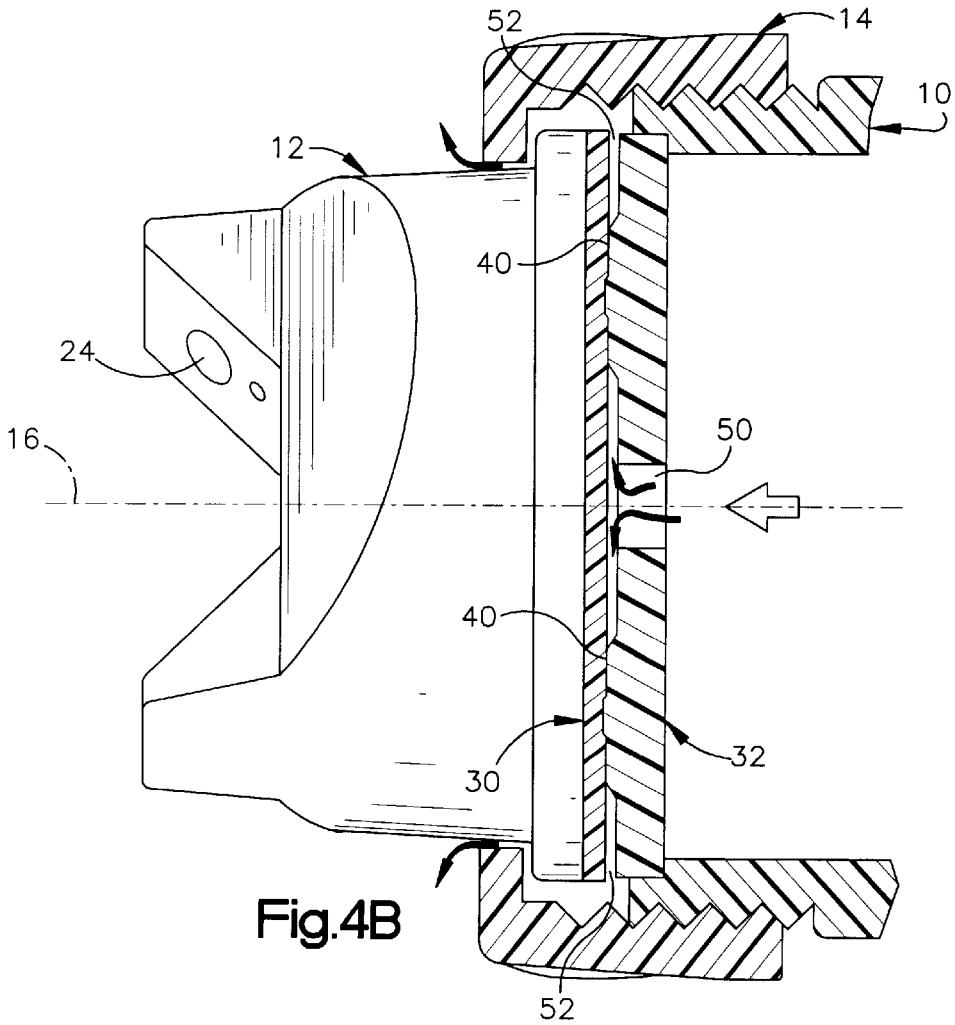
Figure 4C:
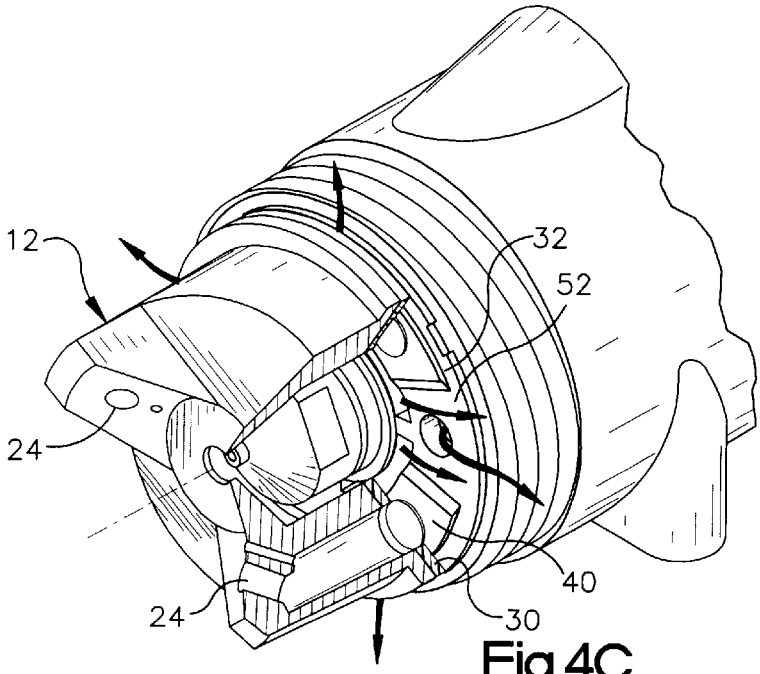

FIGS. 4A, 4B and 4C show the present sprayer in the second position. In the illustrated embodiment, the aircap 12 is rotated to a 45 degree position between vertical and horizontal. The aircap plate apertures 34 are moved to a position where they are blocked by the restriction wings 40, thereby closing off air flow to the spray shaping passages 24. The mating structures 40, 42 are thus offset from each other so that the restriction wings 40 abut the surface plane of the aircap plate 30. Thus, a transverse passage opens up, defining the flow passage 50 as an open vent 52 between the recessed portions 42 and the surface plane of the sprayer plate 32. The airflow is thereby diverted to the vent 52, extending to an edge region defined by the plates 30, 32. In this way, air pressure is relieved within the sprayer 10, and damaging pressure buildup is avoided. From the vent 52, the airflow discharges through the interstices of the retaining ring 14.

As an additional feature of the invention, the wings 40 and recessed portions 42 can be formed to include respective secondary relieved and recessed portions. For example, the wings 40 can include a relieved circular dot 60, and the recessed portion 42 can include a circular dimple 62, which has a corresponding shape for receiving the dot 60. The dots 60 are shaped to contain to the aircap plate apertures 34, and thereby provide additional sealing and securement in the second position, as well as the first position. Of course, the dots 60 and dimples 62 can be of any corresponding shape and be placed on any respective surface feature without departing from the invention.

The dimensions of the various elements formed on the plates 30, 32 can be sized to produce a desired match of flow and pressure between the circular spray and fan spray positions. These dimensions can also be selected to provide higher or lower pressures and/or flow, depending on the specific requirements. This design can be implemented without creating additional components or manufacturing processes, thereby not adding to the cost of manufacture.

As described hereinabove, the present invention solves many problems associated with previous systems, and presents many improvements in efficiency and operability. However, it will be appreciated that various changes in the details, materials and arrangements of parts which have been herein described and illustrated in order to explain the nature of the invention may be made by those skilled in the art within the principle and scope of the invention as expressed by the appended claims.

We claim:

1. A selective venting sprayer assembly comprising:

a sprayer for dispensing a spray of liquid and a spray shaping air flow;

an aircap, attached to the sprayer, for discharging the spray;

at least one spray shaping passage, formed in said aircap, for receiving the air flow and directing it against the spray so as to alter the shape of the spray;

a flow channel assembly, fluidly connecting the aircap to the sprayer, including a flow passage selectively switchable between a first position that admits the air flow from the sprayer to the at least one spray shaping passage, to produce a shaped spray; and a second position that diverts the airflow from the sprayer to a vent, to produce a non-shaped spray, without creating back pressure within the sprayer;

said aircap being attached to the sprayer with a retaining ring;

said vent being along a peripheral edge of the flow channel assembly and wherein the air flow discharges through the retaining ring.

2. A selective venting sprayer assembly comprising: a sprayer for dispensing a spray of liquid and a spray shaping air flow;

an aircap, attached to the sprayer, for discharging the spray;

at least one spray shaping passage, formed in said aircap, for receiving the air flow and directing it against the spray so as to alter the shape of the spray;

a flow channel assembly, fluidly connecting the aircap to the sprayer, including a flow passage selectively switchable between a first position that admits the air flow from the sprayer to the at least one spray shaping passage, to produce a shaped spray; and a second position that diverts the airflow from the sprayer to a vent, to produce a non-shaped spray, without creating back pressure within the sprayer;

said flow channel assembly comprising first and second blocking members, each having at least one aperture and define a transverse passage there between wherein the first and second blocking members are movable with respect to each other such that the variable flow passage is in the first position when each of the at least one apertures are in registration, and in the second position where the at least one apertures are not in registration, thereby blocking one of said apertures and diverting the air flow to the vent;

wherein the first and second blocking members are an aircap plate, affixed to the aircap, and a sprayer plate, affixed to the sprayer, wherein the aircap plate and the sprayer plate are maintained in a substantially abutting relationship;

wherein the aircap and aircap plate are rotatable about a longitudinal axis, and wherein the aircap plate and sprayer plate are rotatably indexed between the first position and the second position;

wherein the transverse passage is defined by mating surfaces, formed respectively on the aircap plate and the sprayer plate, wherein the mating structures are received within each other in the first position to seal the transverse passage against air flow to the vent, and wherein the mating structures are offset from each other in the second position to open up the transverse passage to the vent.

3. The sprayer assembly of claim 2 wherein the aircap plate and the sprayer plate each have a substantially flat surface plane, and wherein the mating surfaces are such that one of said aircap plate and sprayer plate has at least one relieved portion and the respective other of said aircap plate and sprayer plate has at least one corresponding recessed portion, such that in the first position, the surface planes substantially abut and in the second position, the surface planes are displaced.

4. The sprayer assembly of claim 3 wherein the aircap plate and sprayer plate are generally annular, and the respective relieved and recessed portions are generally arcuate.

5. The sprayer assembly of claim 3 wherein the respective relieved and recessed portions are four.

6. The sprayer assembly of claim 3 wherein the at least one recessed portion is formed on the aircap plate and the at least one relieved portion is formed on the sprayer plate.

7. The spray assembly of claim 6 wherein the at least one relieved portion substantially abuts the at least one aperture of the aircap plate in the second position to seal the at least one spray shaping passage.

8. The spray assembly of claim 7 wherein the respective relieved and recessed portions include respective secondary relieved and recessed portions formed thereon, shaped to correspond with the shape of the at least one aircap plate aperture, so as to provide additional sealing in the first position, and to seal the at least one aircap plate aperture in the second position.

9. The spray assembly of claim 8 wherein the secondary relieved and recessed portions are respectively circular dots and dimples.

10. A selective venting sprayer assembly comprising:

a sprayer configured to dispense a spray of liquid and an air flow;

an aircap structure configured to receive said spray of liquid from said sprayer and to discharge said spray of liquid, said aircap structure further being configured to receive said air flow from said sprayer and to direct said air flow against said spray of liquid as to alter the shape of said spray of liquid;

a retaining ring configured to retain said aircap structure on said sprayer; and a rotatably selectable flow plate assembly configured to cooperate with said aircap structure such that said aircap structure directs said air flow against said spray of liquid to alter the shape of said spray of liquid when said flow plate assembly is in a first selectable condition and does not direct said air flow against said spray of liquid to alter the shape of said spray of liquid when said flow plate assembly is in a second condition shifted from said first condition;

said flow plate assembly and said retaining ring together being configured to define an air vent flow path which directs said air flow radially toward said retaining ring and axially from said retaining ring to the atmosphere when said flow plate assembly is in said second selectable condition, whereby said air flow is vented from said assembly without creating back pressure in said sprayer when said flow plate assembly is in said second selectable condition.

* * * * *